US005349771A

United States Patent [19]

Burnett

[11] Patent Number: 5,349,771

[45] Date of Patent: Sep. 27, 1994

[54] RISING BUBBLE DISPLAY DEVICE

[75] Inventor: Kenneth Burnett, Lincolnwood, Ill.

[73] Assignee: Midwest Tropical, Inc., Lincolnwood, Ill.

[21] Appl. No.: 887,171

[22] Filed: May 21, 1992

[51] Int. Cl.[5] ..... G09F 19/00

[52] U.S. Cl. ..... 40/406; 40/439; 285/161

[58] Field of Search ..... 40/406, 407, 439, 441, 40/581; 285/158, 161, 205, 219; 119/248, 245, 269, 254

[56] References Cited

U.S. PATENT DOCUMENTS

| | | | |
|---|---|---|---|
| 1,926,240 | 9/1933 | Maas | 220/355 |
| 2,638,261 | 5/1953 | Poole | 220/355 |
| 3,101,564 | 8/1963 | Stoessel | 40/407 |
| 3,332,433 | 7/1968 | Edmondson | 285/161 |
| 3,355,056 | 11/1967 | Fisch | 220/355 |
| 3,711,698 | 1/1973 | Hess | 40/407 |
| 3,749,424 | 7/1973 | Greene | 285/161 |
| 3,762,082 | 10/1973 | Mincy | 40/581 |
| 3,964,194 | 6/1976 | Gugeler | 40/406 |
| 4,190,312 | 2/1980 | Bailey | 40/410 |
| 4,208,848 | 6/1980 | Kohl | 40/406 |
| 4,352,149 | 9/1982 | Stetler . | |
| 4,498,692 | 2/1985 | Swanson | 285/158 |
| 4,900,068 | 2/1990 | Law | 285/161 |
| 4,939,859 | 7/1990 | Brandt . | |
| 4,974,127 | 11/1990 | Foley . | |
| 5,018,288 | 5/1991 | Yang | 40/406 |
| 5,037,140 | 8/1991 | Anderson | 285/161 |
| 5,106,660 | 4/1992 | Yorel | 40/406 |

FOREIGN PATENT DOCUMENTS

| | | | |
|---|---|---|---|
| 2393385 | 2/1979 | France | 40/406 |

OTHER PUBLICATIONS

Sales Brochure "Aquatic Concepts" Midwest Tropical, Inc., Lincolnwood, Ill. 1991.

*Primary Examiner*—Kenneth J. Dorner
*Assistant Examiner*—Cassandra Davis
*Attorney, Agent, or Firm*—Willian Brinks Hofer Gilson & Lione

[57] ABSTRACT

A rising bubble display device includes a reservoir with a lamp positioned beneath the reservoir. An air pump is mounted adjacent the lamp to pump air via orifices located at the base of the reservoir. A translucent colored element is interposed between the lamp and the reservoir, and this colored element is releasably retained in place such that the user can readily substitute one colored element for another to change the color of the illuminating light. An orifice defining tube is mounted to the reservoir by a sleeve and a threaded cap to provide the necessary seal while allowing ready removal of the orifice defining tube. The reservoir is secured to the base in channels, and the tube is connected to the air pump with a check valve. In this way, the reservoir can readily be isolated from the pump and removed from the base for service. The upper end of the reservoir is covered and a liquid containment element is positioned to extend down into the reservoir and to substantially fill the open end of the reservoir to prevent liquid from escaping from the reservoir.

13 Claims, 4 Drawing Sheets

RISING BUBBLE DISPLAY DEVICE

BACKGROUND OF THE INVENTION

This invention relates to improvements to a rising bubble display device of the type having a reservoir which contains a liquid, a conduit positioned near one end of the reservoir which defines an array of orifices, a pump coupled to the conduit to introduce bubbles of a fluid into the reservoir via the orifices such that the bubbles of fluid move upwardly in the reservoir, and a lamp positioned to illuminate the bubbles of fluid in the reservoir.

The assignee of the present invention has marketed a rising bubble display device of the type described above for some years under the trade name "Water Panel." This prior art Water Panel display utilizes a ten gallon reservoir which weighs over eighty pounds when filled. The reservoir is mounted via channels to stand vertically above a base, and the reservoir defines an array of vertical cells extending upwardly from the base. A fluorescent lamp is positioned vertically above the reservoir to illuminate the upper surface of the reservoir, and an air pump forces air through orifices in a conduit positioned at the base of the reservoir. A clear plastic strip is fixed in place between the lamp and the upper surface of the reservoir.

The Water Panel display has achieved considerable success. Nevertheless, there are certain drawbacks to this device. First, the Water Panel display is essentially factory built, and it is difficult or even impossible for a user to alter or service certain features of this display. For example, it is not possible for the user to change the color of the illuminating light. Furthermore, the orifice defining tube is fixed in the base of the reservoir. On occasion individual orifices may become clogged, and it was in the past difficult or impossible for a user to unclog the individual orifices.

Second, the Water Panel display is not readily serviced by some users. In particular, because of the weight of the reservoir when filled, it generally is not advisable for the user to lift the filled reservoir out of the base (even though this is technically possible) in order to empty reservoir. The Water Panel display does include a check valve interposed between the pump and the reservoir in order to prevent liquid from reaching the pump.

Third, the Water Panel display is relatively expensive to manufacture. In particular, the cells in the reservoir are defined by transverse ribs, each of which defines a notch positioned to receive the orifice defining conduit. This results in a relatively complex mechanical assembly which requires considerable labor to manufacture.

It is accordingly an object of this invention to provide a rising bubble display device of the general type described above which is more readily serviced, more readily repaired, more readily customized by the end user and more readily manufactured.

SUMMARY OF THE INVENTION

According to a first aspect of this invention, a rising bubble display device of type described initially above is provided with a colored translucent element and a retainer mounted adjacent to the reservoir to releasably retain the colored translucent element in place between the lamp and the orifice defining conduit such that the colored translucent element is positioned to color light from the lamp incident on the reservoir. The retainer is configured to allow ready removal and replacement of the colored translucent element. Preferably, the lamp and the colored translucent element are positioned under the reservoir and the orifices.

This aspect of the invention allows the user readily to alter the color of the illuminating light merely by removing one colored translucent element and replacing it with another, differently colored translucent element.

According to a second aspect of this invention, a rising bubble display device of the type described initially above is provided with a sleeve secured to the reservoir around the orifice defining conduit, wherein the sleeve defines a neck external to the reservoir. A cap is releasably secured to the neck around the conduit, and the cap and neck are effective to create a seal around the conduit to prevent liquid leakage out of the reservoir when the cap is secured to the neck, and to allow the conduit to be readily removed from the reservoir when the cap is removed from the neck.

This aspect of the invention allows the user to remove the orifice defining conduit easily for service or replacement.

According to a third aspect of this invention, a rising bubble display device of the type described initially above is provided with a base and means for mounting the lamp and pump in the base such that the lamp is positioned directly under the reservoir and the orifice defining conduit. The reservoir is releasably held in position on the base and a check valve is mounted in the conduit to prevent liquid flow into the pump. A releasable coupling is provided in the conduit on the pump side of the check valve, and the reservoir has a weight when filled with liquid of less than about thirty pounds such that the reservoir may be lifted from the base and the releasable coupling may be released to allow the reservoir to be readily separated from the base for maintenance.

This aspect of the invention allows a user to separate the reservoir from the electrical elements of the display in a simple manner, for example when the display is removed for filling or cleaning.

According to a fourth aspect of this invention, a rising bubble display device of the type described initially above is provided with a removable cover mounted on the reservoir to cover an open end of the reservoir and to allow gas to escape out of the open end of the reservoir. This cover defines a liquid containment element positioned to extend down into the reservoir and to substantially fill the open end of the reservoir such that liquid that contacts the liquid containment element tends to drip back into the reservoir.

This aspect of the invention has been found substantially to eliminate the splashing or dripping of liquid out of the open upper end of the reservoir. This aspect of the invention contrasts with the prior art Water Panel display in which the removable cover does not have a liquid containment element positioned to extend down into the reservoir to substantially fill the open end of the reservoir.

The invention itself, together with further objects and attendant advantages, will best be understood by reference to the following detailed description taken in conjunction with the accompanying drawings.

DETAILED DESCRIPTION OF THE PRESENTLY PREFERRED EMBODIMENTS

Figure 1:
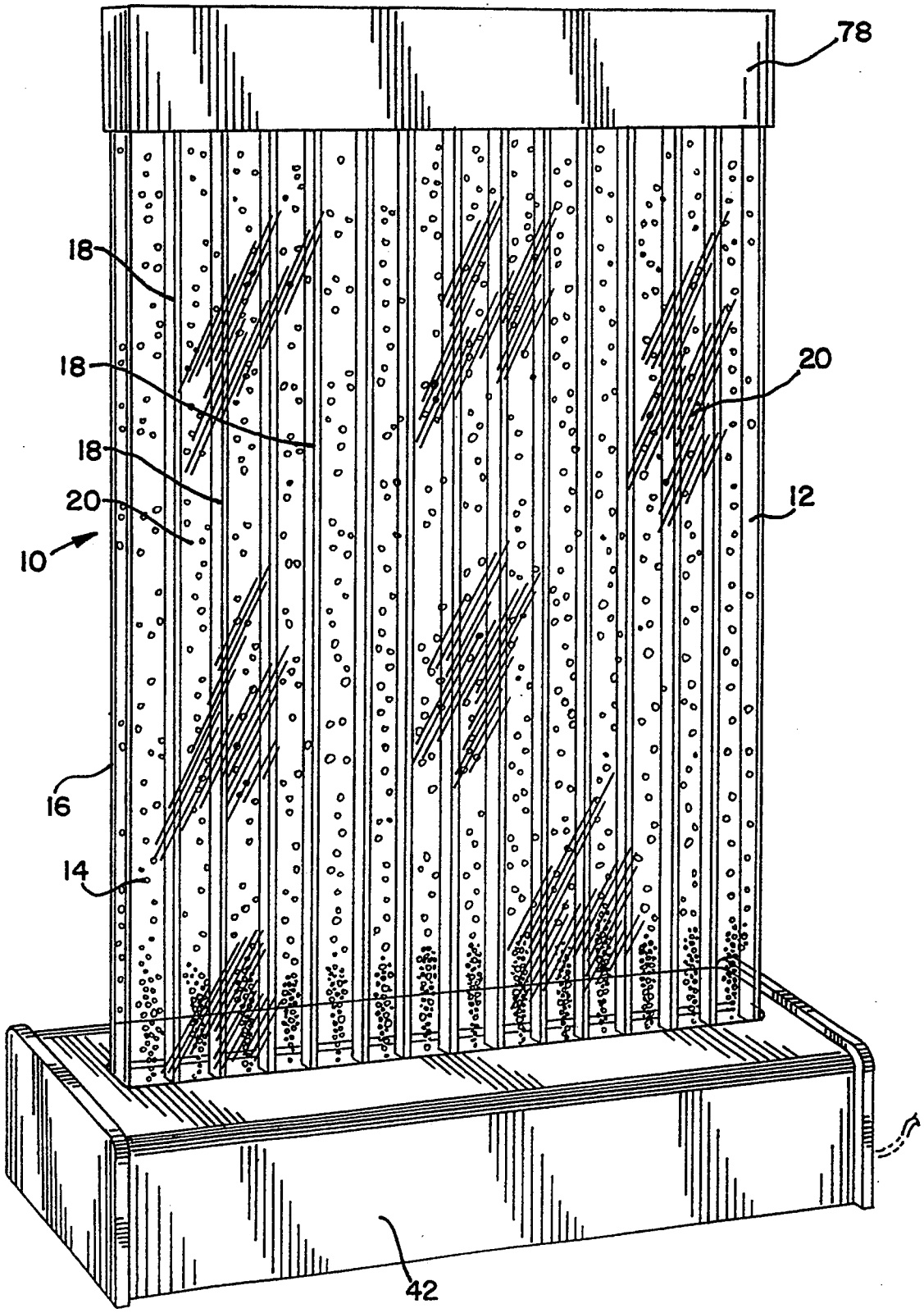
FIG. 1 is perspective view of a rising bubble display device which incorporates a presently preferred embodiment of this invention.
Figure 2:
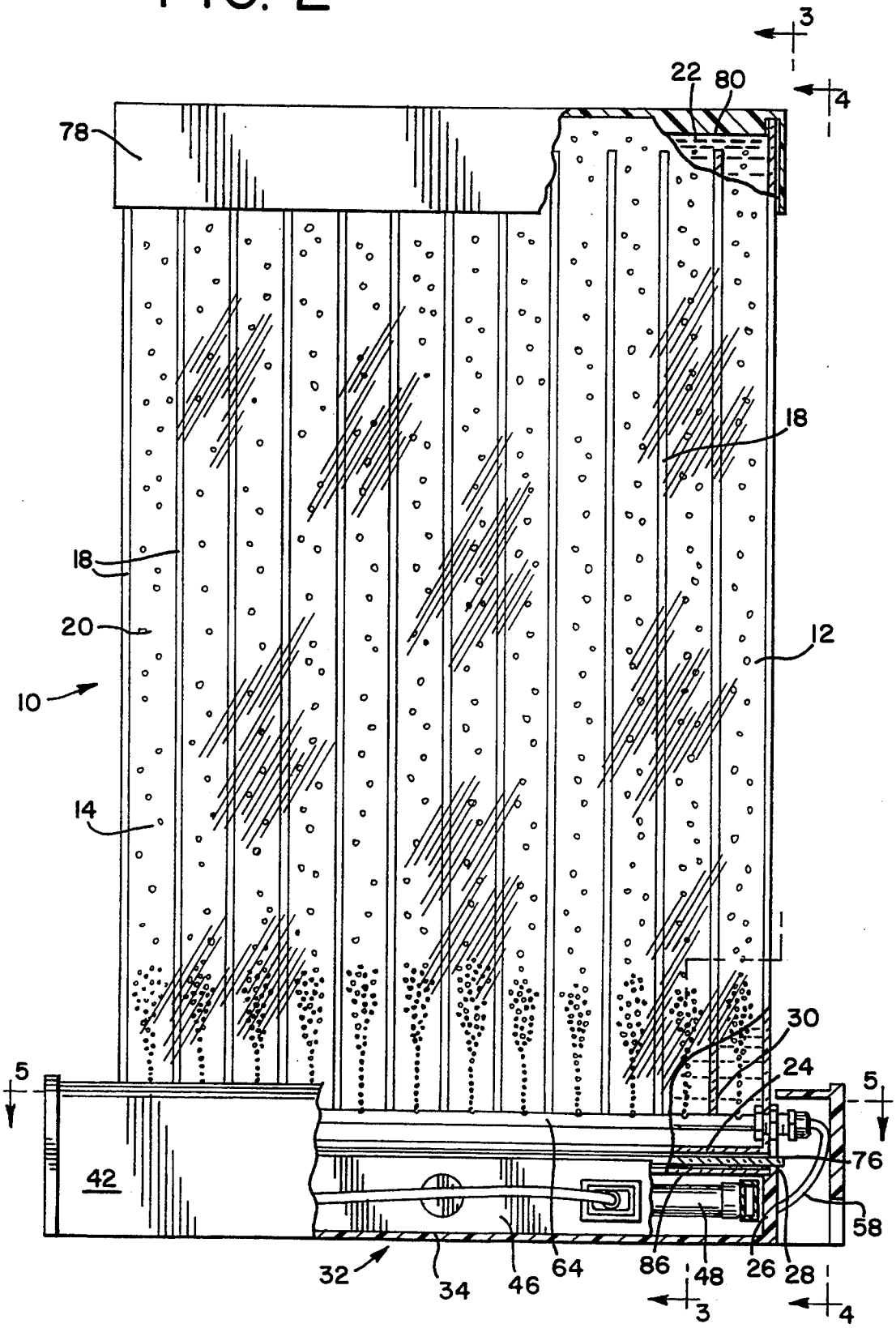
FIG. 2 is a front view in partial cut away of the device of FIG. 1.

Turning now the drawings, FIGS. 1 and 2 show general views of a rising bubble display device 10 which incorporates a presently preferred embodiment of this invention. The device 10 includes a reservoir 12 which is panel shaped and which in this embodiment has a weight of less than 30 pounds and preferably less than 10 pounds when filled. The reservoir 12 defines front and rear faces 14, 16 which are spaced, parallel and see-through. In this embodiment, the faces 14, 16 are transparent.

Figure 6:
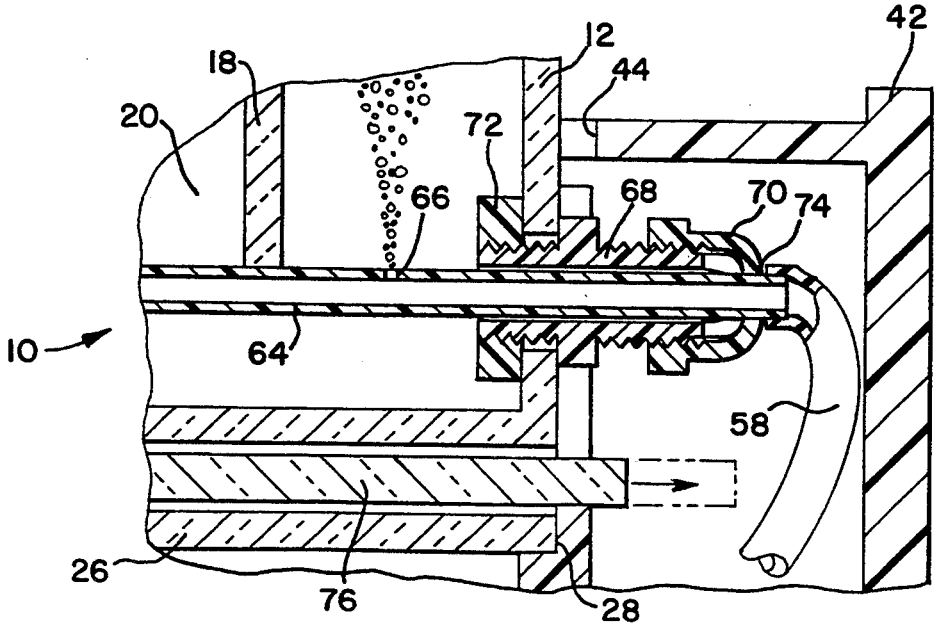
FIG. 6 is a partial sectional view taken along line 6—6 of FIG. 5.

The faces 14, 16 are held in spaced parallel positions by an array of transverse ribs 18 which are bonded to the faces 14, 16 to define parallel, rectangular, elongated cells 20. As shown in FIG. 6, the lower ends 30 of the ribs 18 are squared off, and do not define any type of recess or indentation. The reservoir 12 defines an open upper end 22 and a closed lower end 24 such that each of the cells 20 is substantially water tight and is adapted to retain a liquid such as distilled water.

Adjacent the closed lower end 24 of the reservoir 12 is a box channel 26 which defines open ends 28. The channel 26 can best be seen in FIGS. 2 and 6. The purpose of the channel 26 is to receive a colored strip 76 as described in detail below.

Figure 3:
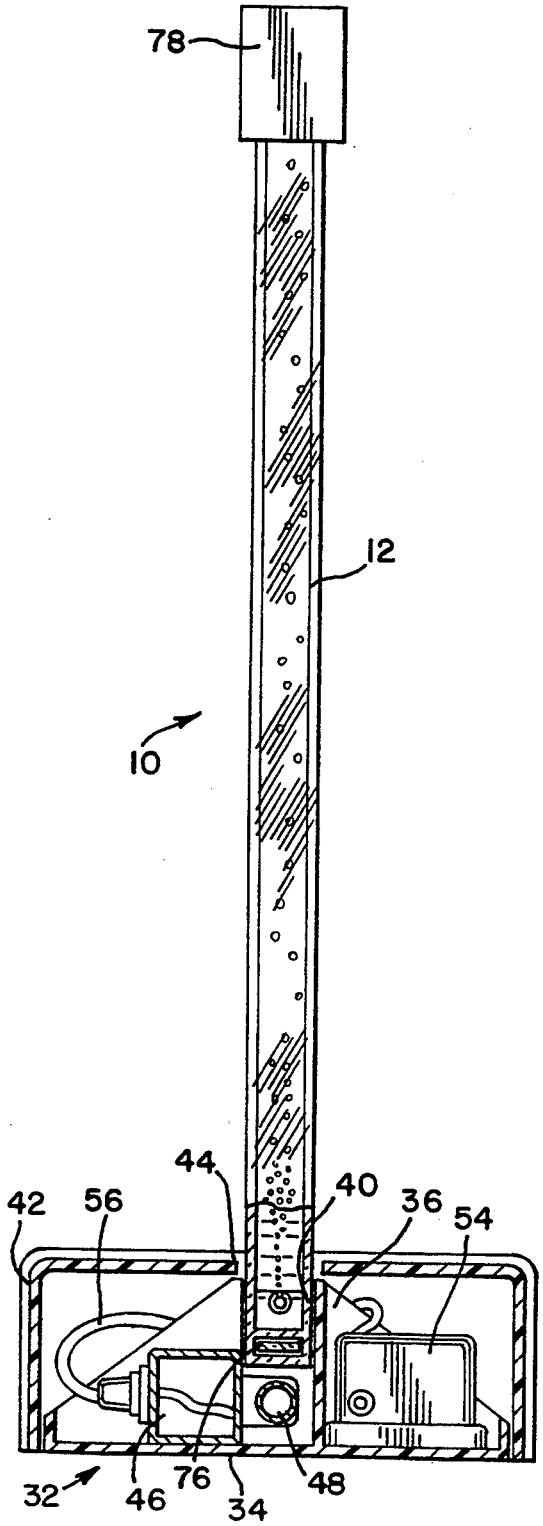
FIG. 3 is a sectional view taken along line 3—3 of FIG. 2.
Figure 4:
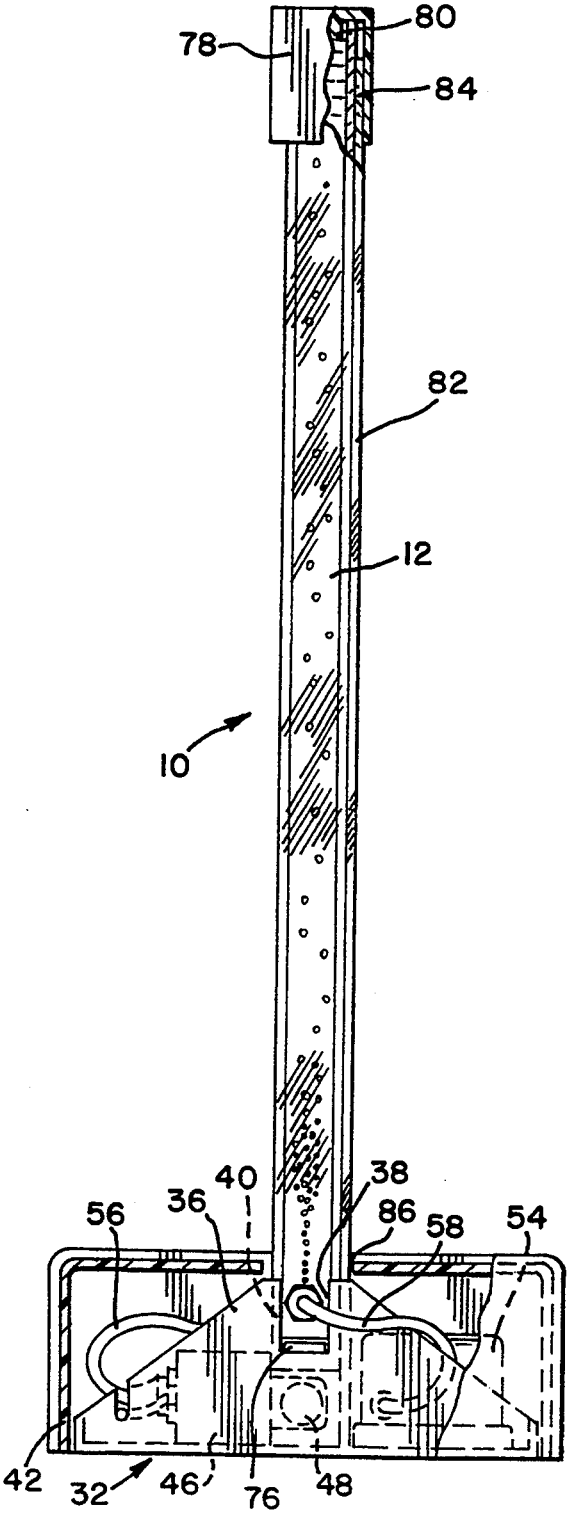
FIG. 4 is a sectional view taken along line 4—4 of FIG.2.

As best shown in FIGS. 2 through 4, the closed end 24 of the reservoir 12 is supported in a base 32. The base 32 includes a bottom plate 34 and two upstanding end plates 36. The end plates 36 define central notches 38 as shown in FIG. 4, and the notches are surrounded by channels 40. Thus, the end plates 36 define spaced, parallel channels 40 which are positioned and shaped to receive the closed lower end 24 of the reservoir 12. As explained below, the channels 40 operate as means for holding the reservoir 12 in an upright position while allowing the reservoir 12 to be lifted out of the base 32 readily. The base 32 is covered by a cover 42 which defines an elongated slot 44 shaped to fit around the reservoir 12. In this embodiment, the cover 42 is not connected to the base 32, but rather the base 32 and the cover 42 are designed to rest on a common support surface (not shown).

Figure 5:
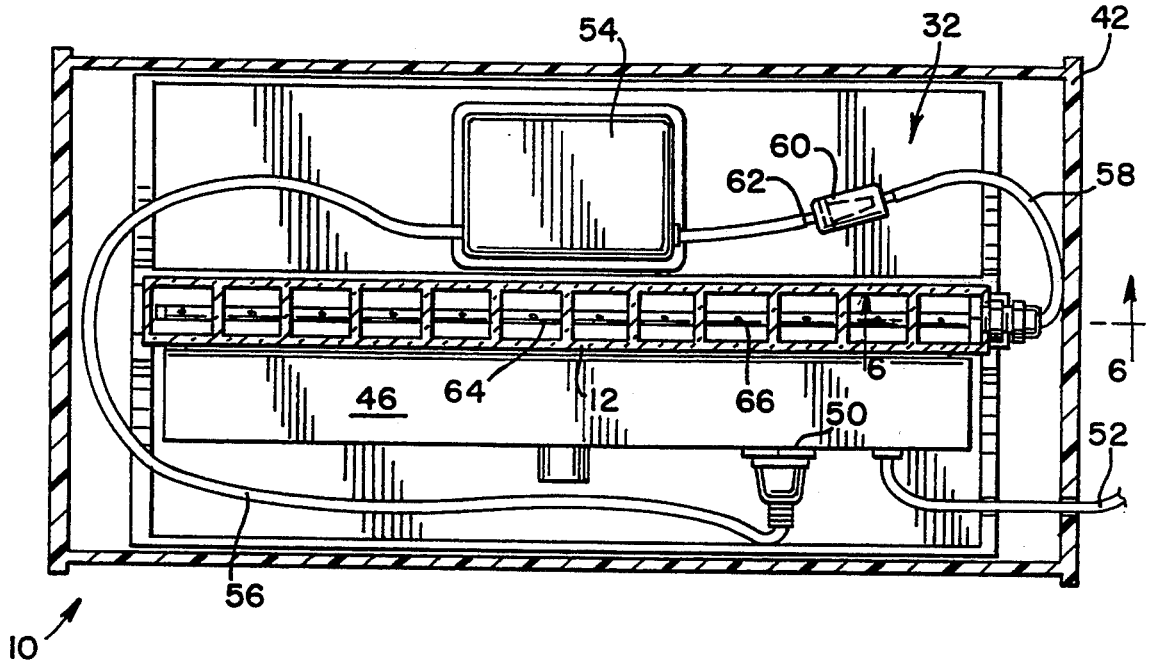
FIG. 5 is a sectional view taken along line 5—5 of FIG. 2.

The base 32 supports a lamp 46 which includes a fluorescent tube 48 disposed beneath and in direct alignment with the reservoir 12 (FIG. 3). The lamp 46 in this embodiment is a conventional ballasted fluorescent lamp, and it includes a power cord 52 and a receptacle 50. Electrical current received via the power cord 52 is applied to the fluorescent tube 48 and via the receptacle 50 and an air pump power cord 56 to an air pump 54 (FIG. 5).

The air pump 54 when energized pumps air via a conduit 58 into the closed lower end 24 of the reservoir 12. The conduit 58 includes a check valve 60 which is oriented to prevent water from the reservoir 12 from flowing into the air pump 54. A releasable coupling 62 such as a conventional vacuum hose coupling is provided between the check valve 60 and the air pump 54.

As best shown in 56, the conduit 58 continues into the closed lower end 24 of the reservoir 20 by means of a tube 64. It has been found preferable to use a transparent self-supporting tube 64 within the reservoir 12 and a flexible tube such as a vacuum hose outside of the reservoir 12. However, in terms of its air delivery function, the tube 64 can be considered to be an extension of the conduit 58. As shown in FIG. 6, the tube 64 is positioned to abut the squared off lower ends 30 of the ribs 18. The tube 64 defines an array of orifices 66, one positioned centrally within each of the cells 20. The air pump 54 pumps air via the conduit 58 and the tube 64 out the orifices 66 at the base of the reservoir 12. Air escaping from the orifices 66 forms bubbles which rise through water in the cells 20 to the open upper end 22.

The tube 64 passes through a sleeve 68 which is sealingly secured to the closed lower end 24 via a nut 72. The sleeve 68 defines a threaded outer end which is adapted to receive a threaded cap 70. When installed as shown in FIG. 6, the cap 70 forms a seal as shown at 74 around the tube 64, thereby preventing the leakage of liquid out of the reservoir 12. However, the cap 70 can readily be removed from the sleeve 68 when it is desired to remove the tube 66 for service or replacement.

As best shown in FIG. 6, a colored strip 78 is positioned within the channel 26 immediately beneath the tube 64. This colored strip 78 is preferably formed of a translucent colored plastic material, which may, for example, be fluorescent. As shown in FIG. 6, the colored strip 76 can readily be removed from the channel 26 by moving the strip 76 axially out of the channel end 28 after the cover 42 has been removed.

As best shown in FIGS. 2 and 4, the device 10 also includes an upper cover 78 which is positioned on the open upper end 22 of the reservoir 12. This upper cover 78 is shaped to fit over the open upper end 22, and the cover 78 defines a liquid containment element 80 that fits down into the reservoir 12, below the uppermost portion of the upper end 22. This liquid containment element 80 substantially fills the open upper end 22 of the reservoir 12 and insures that liquid that has splashed or condensed on the upper cover 78 drips back into the reservoir 12 and does not run down the outside of the reservoir 12.

FIGS. 3 and 4 differ in that FIG. 4 shows the device 10 used with a mirror 82 which is shaped substantially to cover the rear face 16. The mirror 82 defines upper and lower ends 84, 86 which are captured between the reservoir 12 and the upper and lower covers 78, 42, respectively. Thus, the mirror 82 can be retained in place simply, without any additional fastening hardware.

From the foregoing detailed description it should be apparent that the rising bubble display device 10 provides a number of important advantages. First, the colored strip 76 can readily be removed and replaced by the user, who merely lifts the lower cover 42, removes one colored strip 76, and replaces it with another, differently colored strip 76. In this way, the user can readily alter the color of the illuminating light as appropriate.

Second, the air injection tube 64 can readily be removed from the reservoir 12 if it is necessary to clean or replace the tube 64. This can be done simply by removing the cap 70 from the sleeve 78, withdrawing the tube 64, and then either replacing the tube 64 or servicing the tube 64 prior to replacement. In this way, the user does not have to return the relatively large reservoir 12 in the event the tube 64 requires service.

Third, the device 10 has been designed to allow the reservoir 12 to be separated readily from the base 32 for maintenance and service. For example, when a user wishes to fill the reservoir 12 he merely removes the upper and lower covers 78, 42, disconnects the releasable coupling 62, and then lifts the reservoir 12 out of the channels 40 of the base 42. Because the reservoir 12 is light in weight even when filled with water, no special equipment is required. Since all of the electrical components are mounted in the base 32, the upper cover 78 can be a completely passive element and there is no need to bring power to upper cover 78.

Fourth, the liquid containment element 80 of the upper cover 78 substantially eliminates problems associated with water dripping down the sides of the reservoir 12. Because the liquid containment element 80 extends into the reservoir 12, substantially all of the condensed or splashed water on the cover 78 is returned to the reservoir 12.

Other important advantages relate to the manner in which the lamp 48 is positioned in the base 32 under the reservoir 12. As explained above, in the past lamps have been positioned above the reservoir and bubbles and froth on the liquid surface of the reservoir 12 tended to scatter light away from the water in the reservoir 12. By placing the lamp 48 beneath the reservoir 12 more even illumination is provided, and more intense illumination at the base of the reservoir 12 adjacent the orifices 66 is provided.

Other advantages of the rising bubble display device 10 include the use of a single power cord 52 to power both the lamp 46 and the air pump 54, the use of the covers 42, 78 to retain the mirror 82 in place, and the use of ribs 18 with squared off lower ends 30 to reduce manufacturing costs.

The following information regarding preferred materials and dimensions is provided merely to illustrate one preferred form of this invention, and this information is not intended to limit the scope of the invention.

With respect to materials, the reservoir 12, the covers 42, 78 and the base 32 can all be formed of sheet plastic materials such as acrylic. For example, the reservoir 12 can be formed of one-eighth inch acrylic plates which are fused together with a suitable solvent such as acetone. A suitable acrylic plate or sheet can be obtained from Rohm & Haas under the tradename Plexiglass or from DuPont under the tradename LUCITE. Acrylic sheets can also be used for the base 32, the lower cover 42 and the upper cover 78. These elements can be fabricated from separate pieces which are assembled together, or injection molding techniques can be used to facilitate fabrication. The fluorescent tubes 78 can for example be an 8 watt tube, and the air pump 54 can be a conventional aquarium type air pump such as that distributed by Rolf Hagan under the trade name Elite 800. The size of the orifices 66 can be varied as desired, but in this application an orifice diameter of 0.61 mm has been found suitable.

It should of course be understood that a wide range of changes and modifications can be made to the preferred embodiment described above. This description is intended to illustrate one form of the invention but not to limit the scope of the invention, which is defined by the following claims, including all equivalents.

I claim:

1. In a rising bubble display device comprising a reservoir configured to contain a liquid, a pump, at least one conduit coupled to the pump and defining an array of orifices positioned in the reservoir such that the pump introduces bubbles of a fluid into the reservoir via the orifices and the bubbles of fluid move upwardly in the reservoir, and a lamp positioned to illuminate the bubbles of fluid in the reservoir, the improvement comprising:

a colored translucent element; and a retainer mounted adjacent the reservoir, said retainer shaped to define a recess adjacent one end of the reservoir shaped to slideably receive the colored translucent element, said retainer releasably retaining the colored translucent element in place between the lamp and the conduit such that the colored translucent element is positioned to color light from the lamp incident on the reservoir, said colored translucent element slidable in said recess, said retainer configured to allow ready removal and replacement of the colored translucent element.

2. The invention of claim 1 wherein the lamp is positioned under the reservoir and the orifices.

3. The invention of claim 2 wherein the retainer comprises a channel formed in the reservoir and sized to receive the colored translucent element, said channel open at one end to allow removal and replacement of the colored translucent element.

4. In a rising bubble display device comprising a reservoir configured to contain a liquid, a pump, at least one conduit coupled to the pump and defining an array of orifices positioned in the reservoir such that the pump introduces bubbles of a fluid into the reservoir via the orifices and the bubbles of fluid move upwardly in the reservoir, and a lamp positioned to illuminate the bubbles of fluid in the reservoir, the improvement comprising:

said conduit comprising a first tube which defines said array of orifices and a second tube interconnecting the first tube and the pump, said first tube removably mounted in the reservoir;

a sleeve secured to the reservoir around the conduit, said sleeve defining a neck external to the reservoir which receives the first tube such that the first tube passes through a passageway defined by the sleeve and the first tube is removable from the sleeve; and a cap releasably secured to the neck around the conduit;

said cap and neck effective (1) to create a seal around the first tube to prevent liquid leakage out of the reservoir around the first tube at least when the cap is secured to the neck, and (2) to allow the first tube to be readily removed from the reservoir when the cap is removed from the neck.

5. The invention of claim 4 wherein the neck and the cap are threaded such that the cap can be screwed onto the neck.

6. In a rising bubble display device comprising a reservoir configured to contain a liquid, a pump, at least one conduit coupled to the pump and defining an array of orifices positioned in the reservoir such that the pump introduces bubbles of a fluid into the reservoir via the orifices and the bubbles of fluid move upwardly in the reservoir, and a lamp positioned to illuminate the bubbles of fluid in the reservoir, the improvement comprising:

a base;

said lamp and pump mounted in the base such that the lamp is positioned under the reservoir and the conduit;

means for releasably holding the reservoir in position on the base;

a check valve mounted in the conduit to prevent liquid flow into the pump; and a releasable coupling on the conduit on the pump side of the check valve;

said conduit passing into the reservoir at a location within the base, and said reservoir having a closed lower end;

said reservoir defining an open end that extends substantially across the reservoir and a removable cover positioned over the open end, said removable cover extending substantially across the reservoir;

said reservoir having a weight when filled with liquid of less than about thirty pounds such that the liquid filled reservoir may be lifted from the base after and the releasable coupling may be released to allow the reservoir to be readily separated from the base for maintenance;

wherein the reservoir comprises first and second spaced, parallel, see-through faces separated by an array of transverse ribs, wherein the ribs abut the faces to define an array of parallel cells in the reservoir, wherein the ribs each define a respective unrecessed lower end surface, and wherein the conduit is positioned between the faces, transverse and adjacent to the lower end surfaces.

7. The invention of claim 6 wherein the releasably holding means comprises a pair of opposed, parallel channels, each positioned to receive a respective side of the reservoir to hold the reservoir in an upright position.

8. In a rising bubble display device comprising a reservoir configured to contain a liquid, a pump, at least one conduit coupled to the pump and defining an array of orifices positioned in the reservoir such that the pump introduces bubbles of a fluid into the reservoir via the orifices and the bubbles of fluid move upwardly in the reservoir, and a lamp positioned to illuminate the bubbles of fluid in the reservoir, the improvement comprising:

a removable cover mounted on the reservoir to cover an open end of the reservoir, said cover comprising an outer part positioned alongside an outer portion of the reservoir and an inner part positioned alongside an inner portion of the reservoir, said inner and outer parts receiving a portion of the reservoir therebetween, said cover operative to allow gas to escape out of the open end of the reservoir, said inner part of said cover defining a liquid containment element positioned to extend down into the reservoir and to substantially fill the open end of the reservoir such that liquid that contacts the liquid containment element tends to drip back into the reservoir;

wherein the reservoir comprises first and second spaced, parallel, see-through faces separated by an array of transverse ribs, wherein the ribs abut the faces to define an array of parallel cells in the reservoir, wherein the ribs each define a respective unrecessed lower end surface, and wherein the conduit is positioned between the faces, transverse and adjacent to the lower end surfaces.

9. The invention of claim 1 or 4 or 6 further comprising a mirror positioned alongside a face of the reservoir.

10. The invention of claim 9 further comprising a removable cover mounted on the reservoir to cover an open end of the reservoir, wherein the cover is sized to retain the mirror alongside the reservoir.

11. The invention of claim 1 or 4 or 6 or 8 wherein the pump and the lamp are coupled to a common electrical power cable.

12. The invention of claim 1 or 4 wherein the reservoir comprises first and second spaced, parallel, see-through faces separated by an array of transverse ribs, wherein the ribs abut the faces to define an array of parallel cells in the reservoir, wherein the ribs each define a respective unrecessed lower end surface, and wherein the conduit is positioned between the faces, transverse and adjacent to the lower end surfaces.

13. In a rising bubble display device comprising a reservoir configured to contain a liquid, a pump, at least one conduit coupled to the pump and defining an array of orifices positioned in the reservoir such that the pump introduces bubbles of a fluid into the reservoir via the orifices and the bubbles of fluid move upwardly in the reservoir, and a lamp positioned to illuminate the bubbles of fluid in the reservoir, the improvement comprising:

a base;

said lamp and pump mounted in the base such that the lamp is positioned under the reservoir and the conduit;

means for releasably holding the reservoir in position on the base;

a check valve mounted in the conduit to prevent liquid flow into the pump; and a releasable coupling on the conduit on the pump side of the check valve;

said conduit passing into the reservoir at a location within the base, and said reservoir having a closed lower end;

a sleeve secured to the reservoir around the conduit, said sleeve defining a neck external to the reservoir which receives the conduit such that the conduit passes through a passageway defined by the sleeve and the conduit is removable from the sleeve; and a cap releasably secured to the neck around the conduit;

said cap and neck effective (1) to create a seal around the conduit to prevent liquid leakage out of the reservoir around the conduit at least when the cap is secured to the neck, and (2) to allow the conduit to be readily removed from the reservoir when the cap is removed from the neck;

said reservoir having a weight when filled with liquid of less than about thirty pounds such that the liquid filled reservoir may be lifted from the base after and the releasable coupling may be released to allow the reservoir to be readily separated from the base for maintenance;

wherein the reservoir comprises first and second spaced, parallel, see through faces separated by an array of transverse ribs, wherein the ribs abut the faces to define an array of parallel cells in the reservoir, wherein the ribs each define a respective unrecessed lower end surface, and wherein the conduit is positioned between the faces, transverse and adjacent to the lower end surfaces.

* * * * *

UNITED STATES PATENT AND TRADEMARK OFFICE

CERTIFICATE OF CORRECTION

PATENT NO. : 5,349,771

DATED : September 27, 1994

INVENTOR(S) : Kenneth Burnett

It is certified that error appears in the above-indentified patent and that said Letters Patent is hereby corrected as shown below:

Column 8, line 62:
In claim 13, line 44, after the first occurrence of "ribs" insert --and a bottom--.

Column 8, line 65:
In claim 13, line 47, after "surface," insert --wherein the end surfaces are spaced above the bottom to define a conduit receiving region between the end surfaces and the bottom--.

Column 8, line 66:
In claim 13, line 48, after "faces," insert --between the bottom and the end surfaces, and--.

Signed and Sealed this

Sixteenth Day of April, 1996

Bruce Lehman

*Attest:*

BRUCE LEHMAN

*Attesting Officer*

*Commissioner of Patents and Trademarks*